US011432665B2

(12) United States Patent
Parnes

(10) Patent No.: US 11,432,665 B2
(45) Date of Patent: Sep. 6, 2022

(54) PATTERNED COMFORTER

(71) Applicant: DOWN-LITE INTERNATIONAL, INC., Mason, OH (US)

(72) Inventor: Brian Parnes, Cincinnati, OH (US)

(73) Assignee: DOWN-LITE INTERNATIONAL, INC., Mason, OH (US)

( * ) Notice: Subject to any disclaimer, the term of this patent is extended or adjusted under 35 U.S.C. 154(b) by 0 days.

(21) Appl. No.: 16/786,121

(22) Filed: Feb. 10, 2020

(65) Prior Publication Data

US 2020/0253394 A1 Aug. 13, 2020

Related U.S. Application Data

(60) Provisional application No. 62/804,854, filed on Feb. 13, 2019.

(51) Int. Cl.
*A47G 9/02* (2006.01)

(52) U.S. Cl.
CPC ..... *A47G 9/0207* (2013.01)

(58) Field of Classification Search
CPC ..... A47G 9/0207; A47G 9/02; A47G 9/0223; A47G 9/023; A47G 9/0238; A47G 2009/0276
See application file for complete search history.

(56) References Cited

U.S. PATENT DOCUMENTS 5,205,811 A * 4/1993 Fornarelli ..... A47G 9/1045 600/28
2011/0283453 A1* 11/2011 Low ..... A47G 9/0261 5/501
2012/0186015 A1* 7/2012 Shattuck ..... A47G 9/02 5/500
2013/0263375 A1* 10/2013 Regan ..... A47G 9/0207 5/500
2014/0115783 A1* 5/2014 Rock ..... D04B 1/04 5/482
2014/0283722 A1* 9/2014 Pinoli ..... D05B 97/12 112/117

(Continued)

*Primary Examiner* — David R Hare
*Assistant Examiner* — George Sun
(74) *Attorney, Agent, or Firm* — Thompson Hine LLP

(57) ABSTRACT

In one aspect, a patterned bedding article, such as a comforter, comprising an outer fabric shell comprising at least a top panel and a bottom panel is provided where the stitching connecting the at least a top panel and a bottom panel results in the generation of an overall non-uniform pattern, where the overall non-uniform pattern creates a plurality of spaces containing a fill material(s), where the spaces are at least a first sized space and a larger second sized space, and where the first sized spaces are located at a first portion of the comforter and the larger second sized spaces are located in a second portion of the comforter. The larger second sized spaces contain more fill material than the first sized spaces, and thus, provide increased warmth in the second portion of the comforter containing the larger second sized spaces, for example, at a central area of the patterned comforter. The first spaces, due to their smaller size, have increased durability as compared to the larger second sized spaces, and thus, provide increased durability in the first portion of the comforter containing the first sized spaces, for example, at the peripheral area of the patterned comforter.

15 Claims, 8 Drawing Sheets

(56) References Cited

U.S. PATENT DOCUMENTS

| | | | | |
|---|---|---|---|---|
| 2014/0373277 | A1* | 12/2014 | Fan | A47G 9/0238 5/502 |
| 2015/0366734 | A1* | 12/2015 | Kjell | A61M 21/02 601/84 |
| 2017/0295961 | A1* | 10/2017 | Alletto | A47G 9/0261 |
| 2019/0282004 | A1* | 9/2019 | Schwartz | A47G 9/0207 |
| 2020/0128978 | A1* | 4/2020 | Werthaiser | A47G 9/023 |
| 2020/0179641 | A1* | 6/2020 | Russin, Sr. | A61M 21/02 |

* cited by examiner

PATTERNED COMFORTER

CROSS-REFERENCE TO RELATED APPLICATION

This application claims the benefit of U.S. Provisional Patent Application No. 62/804,854, filed Feb. 13, 2019, which is incorporated by reference herein in its entirety.

FIELD OF THE INVENTION

A bedding article, such as a comforter, filled with at least a first material, in a plurality of spaces created by a patterned stitching between the fabrics comprising the outer shell of the comforter is provided, and more particularly to a comforter wherein the created spaces are larger in a first portion of the comforter and smaller in a second portion of the comforter.

BACKGROUND

Comforters stuffed with down or down-like fill material are very popular for a number of reasons. They are warm and comfortable. Furthermore, they are characterized by bulk and softness. Finally, despite their bulk, they are extremely light in weight.

In general, the construction of the comforter, the type of fill material used, and the amount of fill material used, will determine the warmth characteristics of the structure. To this end, it is not unusual for manufacturers to offer various types and styles of comforters, differing in the fill material used and the amount of fill material used, so as to have different warmth characteristics.

In addition, the entire comforter does not need to provide optimal warmth as a user is generally only covered by a portion of the comforter. It would be desirable, therefore, to produce a comforter which provides warmth comfort levels to the user by providing a larger amount of fill in a portion or portions of the comforter which would cover a user, and to provide a lesser amount of fill in the remaining portion or portions of the comforter. Additionally, it is also desirable to produce such a patterned comforter such that its durability, particular at the edge portions of the comforter, are increased.

SUMMARY

In one aspect, a patterned comforter comprising an outer fabric shell comprising at least a top panel and a bottom panel is provided where the stitching connecting the at least a top panel and a bottom panel results in the generation of an overall non-uniform pattern, where the overall non-uniform pattern creates a plurality of spaces containing a fill material(s), where the plurality of spaces are at least a first sized space and a larger second sized space, and where the first sized spaces are located at a first portion of the comforter and the larger second sized spaces are located in a second portion of the comforter. The larger second sized spaces contain more fill material than the first sized spaces, and thus, provide increased warmth in the second portion of the comforter containing the larger second sized spaces. The first spaces, due to their smaller size, have increased durability as compared to the larger second sized spaces, and thus, provide increased durability in the first portion of the comforter containing the first sized spaces, for example, at the peripheral area of the patterned comforter. In additional embodiments, the plurality of spaces comprises more than two different sized spaces, and can include 3, 4, 5, or more different sized spaces. Each of the additional third, fourth, fifth, and more sized spaces are disposed in a third portion of the comforter, a fourth portion of the comforter, a fifth portion of the comforter, etc.

DETAILED DESCRIPTION

Figure 2:
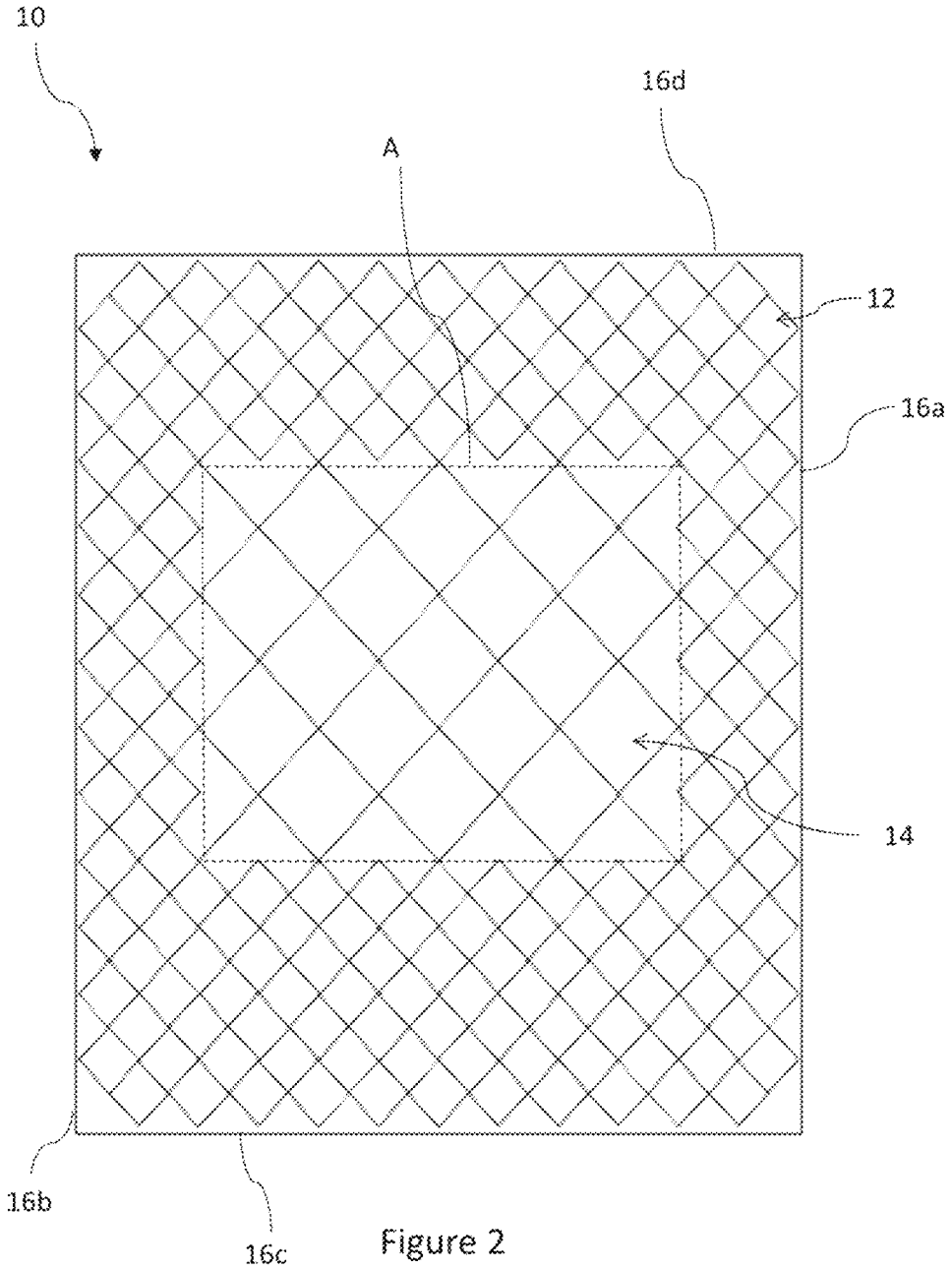
FIG. 2 is a front plan view of one embodiment of a patterned comforter.
Figure 3:
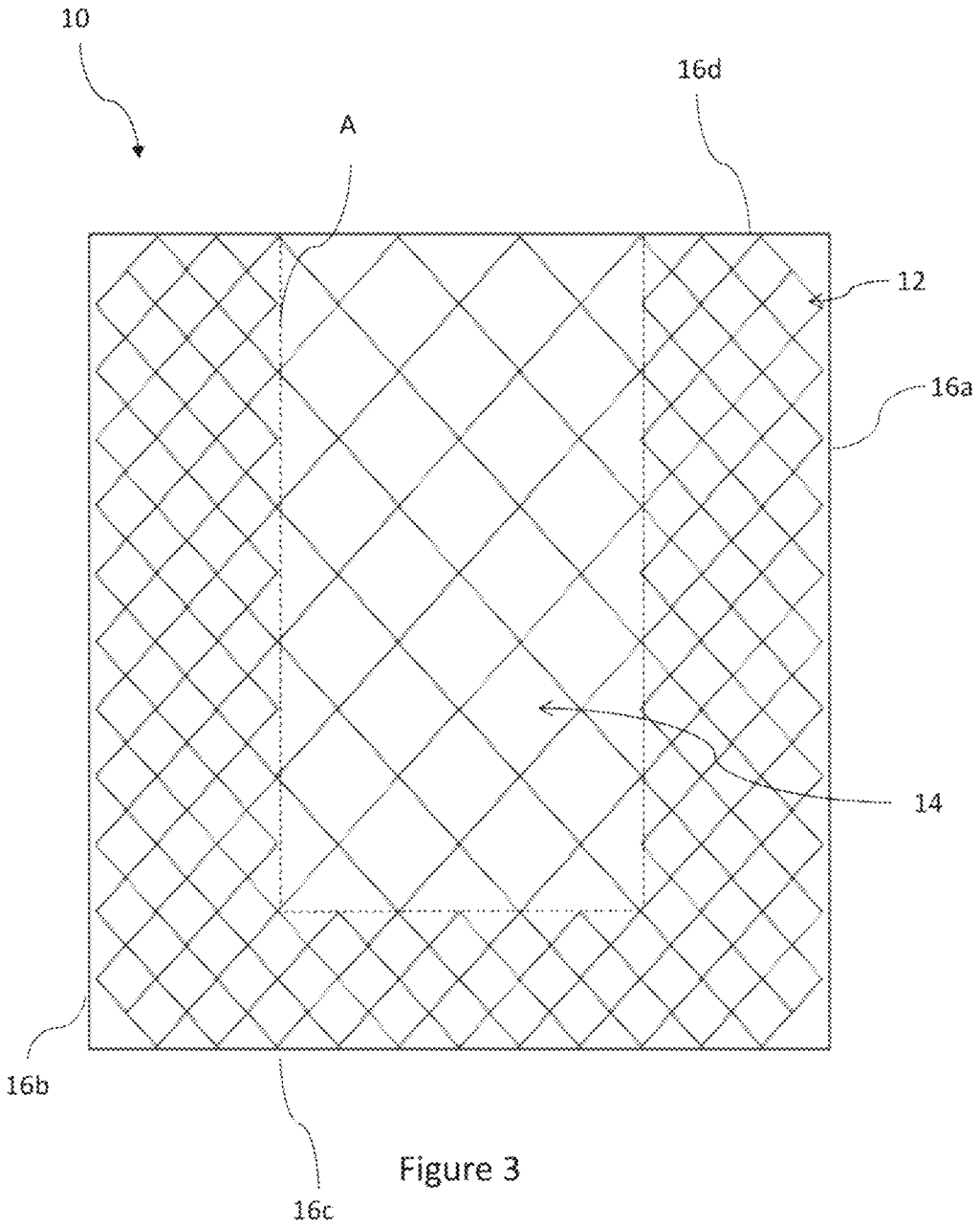
FIG. 3 is a front plan view of another embodiment of a patterned comforter.
Figure 4:
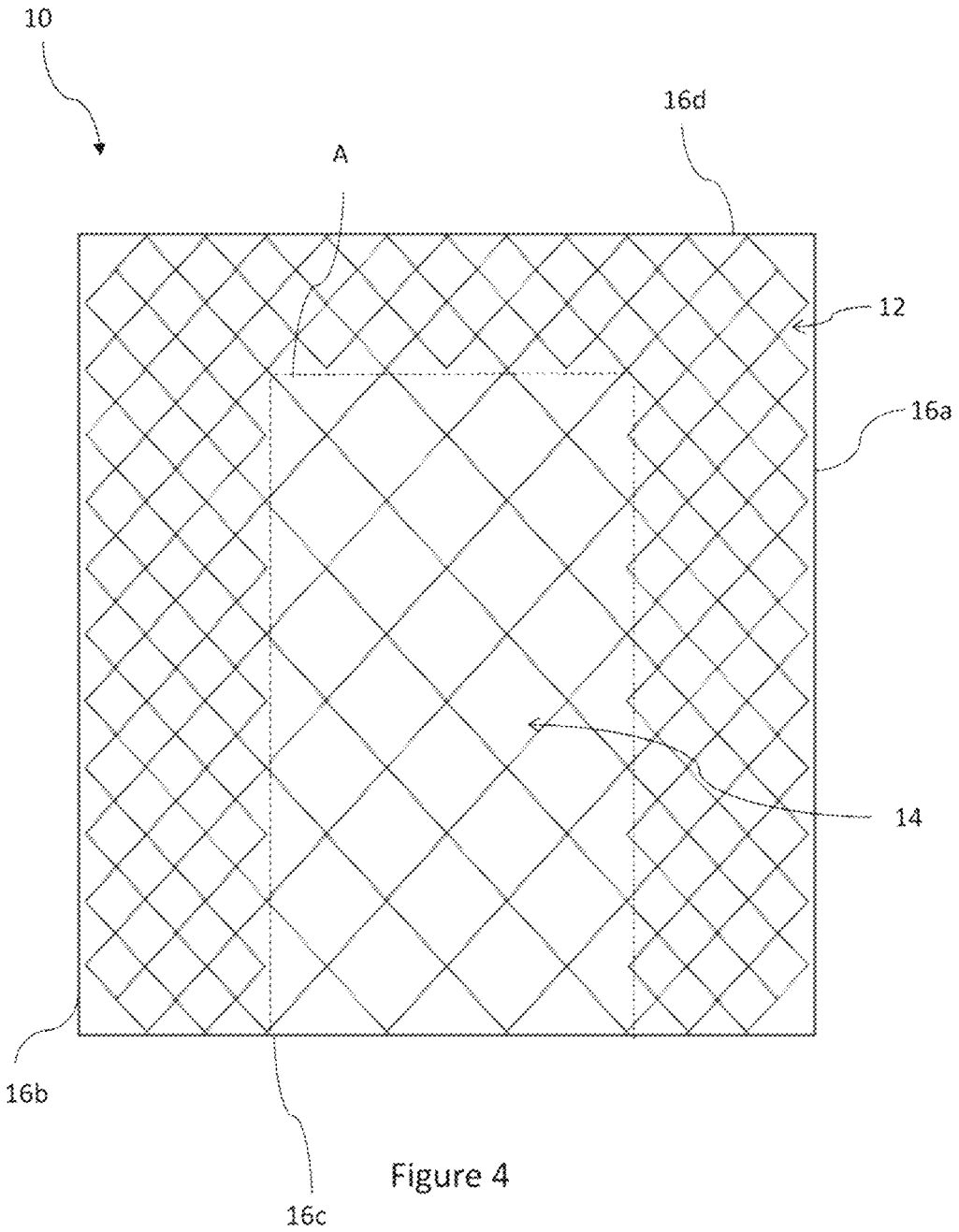
FIG. 4 is a is a front plan view of another embodiment of a patterned comforter.
Figure 5:
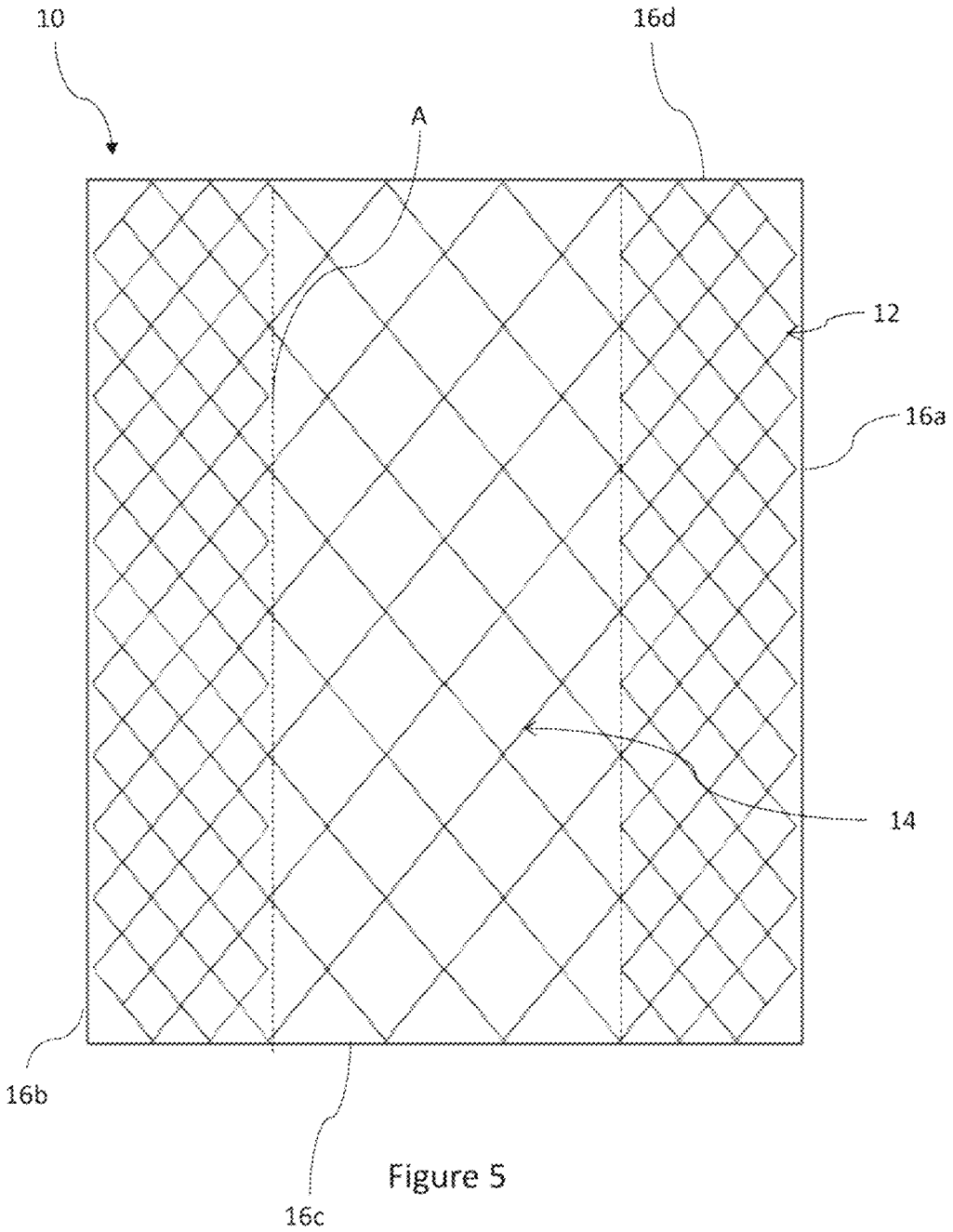
FIG. 5 is a front plan view of another embodiment of a patterned comforter.

In one embodiment (FIGS. 1-7), the first portion 12 of the comforter 10 corresponds to a peripheral area of the comforter 10 and the second portion 14 of the comforter 10 corresponds to a central area of the comforter 10. In one embodiment, the first portion 12 of the comforter 10 is defined by the edges 16*a, b, c*, and *d*, of the comforter 10 and an interiorly defined demarcation A (FIGS. 2-7), and the second portion 14 of the comforter 10 is defined by the interiorly defined demarcation A of the first portion 12 and contains the central area of the comforter 10. In this embodiment (FIG. 2), the first portion 12 of the comforter 10 comprises the periphery of the comforter 10 on all four sides 16*a-d* and the second portion 14 of the comforter 10 is the central area of the comforter 10. However (FIG. 3), it is also contemplated that the first portion 12 of the comforter 10 only includes three edges of the comforter, such as a left edge 16*a*, a right edge 16*b*, and a bottom or "foot" edge 16*c*, and the second portion 12 of the comforter comprises the top or "head" edge 16*d*, along with the central area. Alternatively (FIG. 4), the first portion 12 of the comforter 10 only includes three edges of the comforter 10, such as a left edge 16*a*, a right edge 16*b*, and a top or "head" edge 16*d*, and the second portion 14 of the comforter 10 comprises the bottom or "foot" edge 16*c*, along with the central area. Additionally (FIG. 5), the first portion 12 of the comforter 10 can only include two edges of the comforter 10, such as the left edge 16*a* and the right edge 16*b*, and the second portion 14 of the comforter 10 comprises the top of "head" edge 16*d*, the bottom or "foot" edge 16*c*, along with the central area 18. Alternatively (FIG. 6), the first portion 12 of the comforter 10 can only include two edges of the comforter 10, such as the top or "head" edge 16*d* and the bottom or "foot" edge 16*c*, and the second portion 14 of the comforter 10 comprises the left edge 16*a*, the right edge 16*b*, along with the central area. Additionally not shown), the first portion 12 of the comforter 10 can only include one edge of the comforter 10, selected from the left edge 16*a*, the right edge 16*b*, the top or "head" edge 16*d*, or the bottom or "foot" edge 16*c*, and the second portion 14 of the comforter 10 comprises the remaining three edges, along with the central area.

Figure 1:
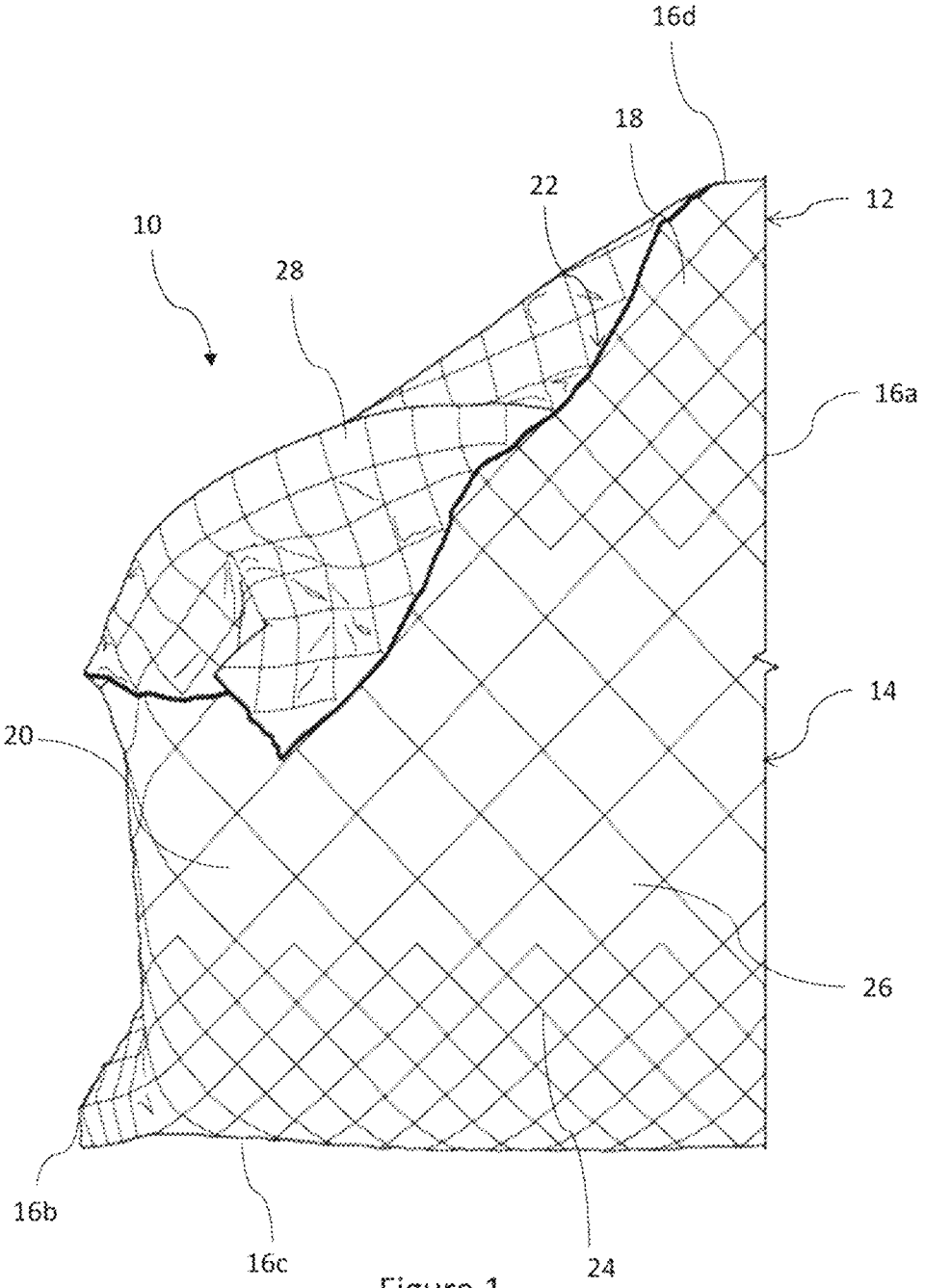
FIG. 1 is a front perspective view of a patterned comforter.
Figure 6:
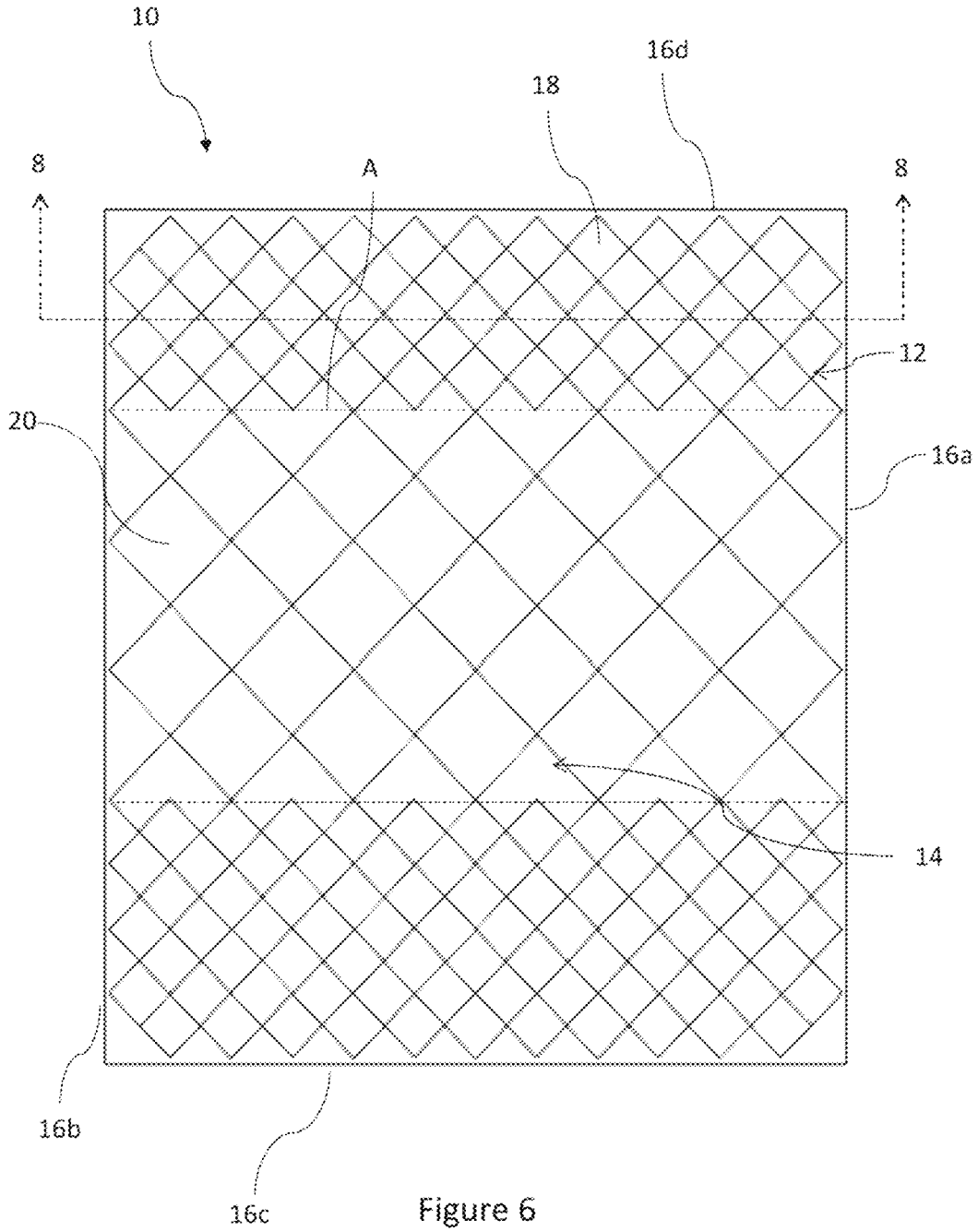
FIG. 6 is a front plan view of another embodiment of a patterned comforter.
Figure 7:
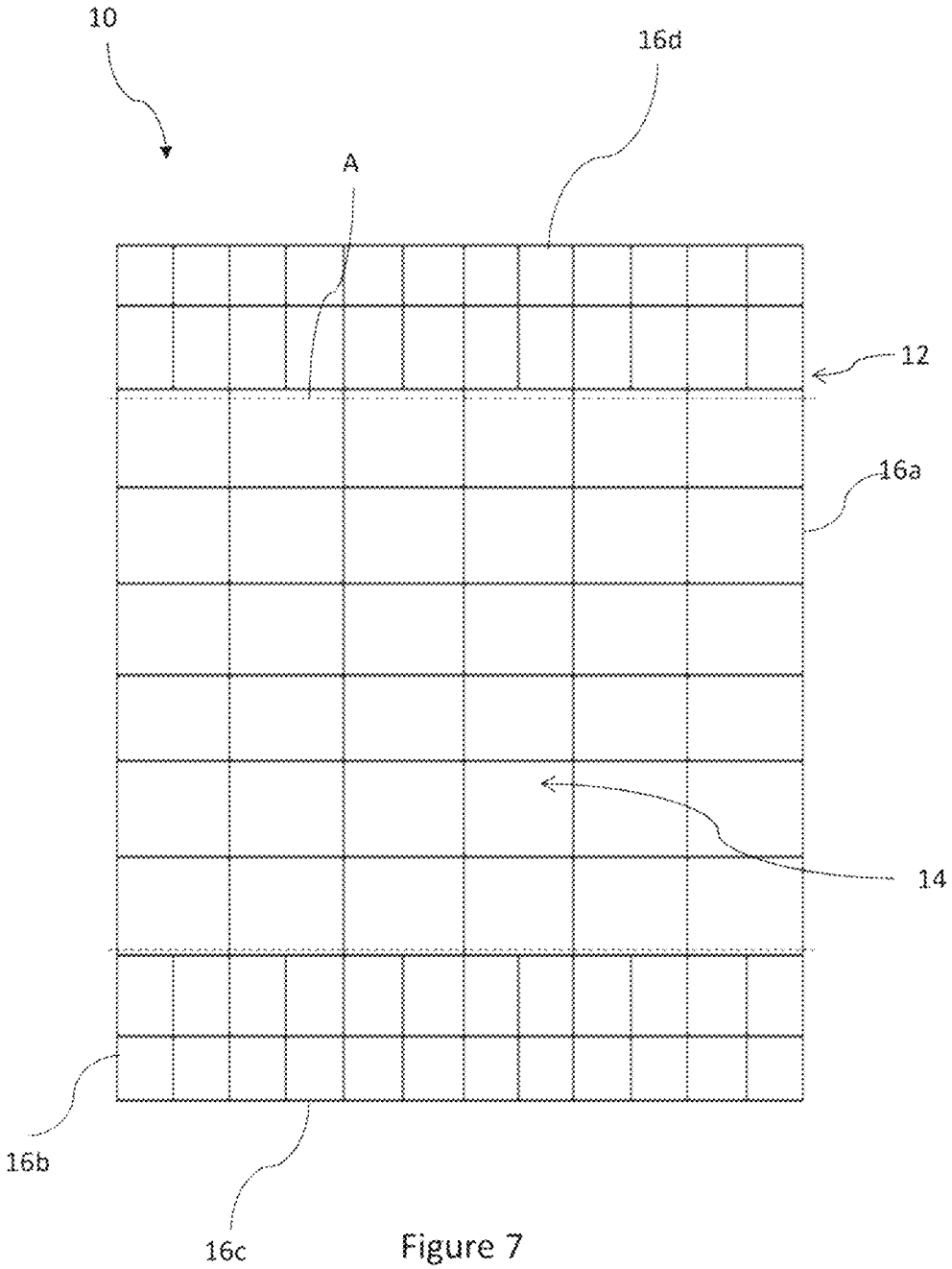
FIG. 7 is a front plan view of another embodiment of a patterned comforter.

With reference to FIGS. 1 and 6, while the above described patterned comforter 10 focused on the exemplary embodiment having a first portion 12 with the first sized space 18 and a second portion 14 with the larger second sized space 20, it is within the scope of the described patterned comforter 10 to alternatively have additional portions of the comforter 10, such as a third portion, with the third portion having intermediate sized spaces, and in one embodiment, the third portion being located between the first and second portions of the patterned comforter, e.g., located between the peripherally disposed first portion and the centrally disposed second portion.

As described above in the exemplary embodiment, the patterned comforter 10 contains a non-uniform stitching pattern which results in a plurality of spaces between the outer fabric shell 22, and in one embodiment, a plurality of the first sized spaces 18 and a plurality of the larger second sized spaces 20. In one embodiment, the stitching pattern comprises intersecting lines 24, such that spaces having generally square (FIG. 7), rectangular, or diamond shapes are created. However, it is within the scope of the described patterned comforter that the described spaces can be of any shape as long as at least two different sized spaces are created by the non-uniform patterned stitching. In the embodiment where there are a first sized space 18 and a larger second sized space 20, the area of the larger second sized space 20 is at least 10% greater than the area of the first sized space 18. By at least 10% greater, it is meant that the area of the larger second sized space 20 is 10%, 20%, 30%, 40%, 50%, 60%, 70%, 80%, 90%, 100%, 150%, 200%, 300%, 400%, 500%, or more greater than the area of the first sized space 18.

Figure 8:
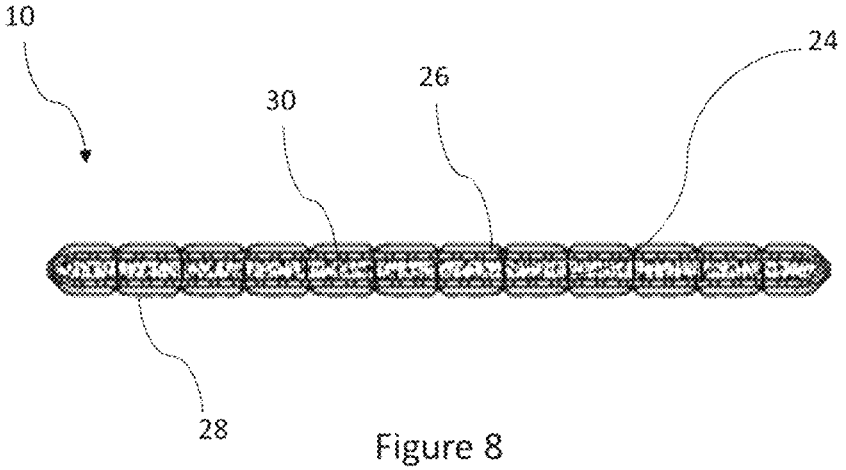
FIG. 8 is a cross sectional view of the comforter of FIG. 6, taken along line 8-8.

As shown in FIGS. 1 and 8, in Ti one embodiment, outer fabric shell comprises at least a top panel 26 and a bottom panel 28. The top 26 and bottom 28 shell panels are sewn together about their peripheral edges 16*a-d*. The fill materials 30 are captively located and contained between the top 26 and bottom 28 shell panels. Such a construction is well known in the art and is generally referred to as a sewn-through design. It will be understood that joining of the top 26 and bottom 28 shell panels can be accomplished by using this method, or any other method known in the art. The top 26 and bottom 28 panels of the shell 22 may be made of any appropriate material. While not intended to be so limited, 100% cotton fabric is an often used material for this purpose. Additionally, the top 26 and bottom 28 panels need not be the same material. In one embodiment, as shown in FIGS. 1 and 8, the top 26 and bottom 28 shell panels are additionally joined together along a plurality of stitched seams 24 according to the overall non-uniform pattern, and dividing the comforter 10 into a plurality of spaces containing a fill material 30, where the plurality of spaces includes at least two different sized spaces 18 and 20, defining at least a first 12 and a second portion 14 of the comforter 10. In another embodiment, a middle panel knot shown) is provided, and located between the upper and lower panels, such that the middle panel divides an interior volume of the comforter into an upper portion and a lower portion.

While the above description focused on the exemplary embodiment of a comforter 10, the description also applies to other bedding or warmth-providing articles such as a blanket or a throw, collectively referred to as a bedding article.

The type of fill material 30 referred to above is not limited and in various embodiments, the fill material 30 is down or a down-like material, such as feathers, or a combination of down and feathers. Alternatively, the fill material 30 is a non-down or non-down-like material. In one embodiment, the fill material 30 is wool, polyester, cotton, tencel, or combinations thereof. In one embodiment, the fill material 30 is a combination of down or a down-like material and a non-down or non-down-like material. In various embodiments, the fill material(s) 30 can be in the form of batted or blown. In one embodiment, the polyester fiber is a microfiber having a fiber width of less than 1 denier. In one embodiment, the polyester fiber has a width of 4 denier or less. In one embodiment, the feather is microfeather having a length of about 2 cm to 4 cm. In one embodiment, the feather has a length of about 4 cm to about 6 cm. In one embodiment, the batted material is selected from cotton batting, polyester batting, wool batting, cotton/poly blend batting, which are typically 80% cotton and 20% polyester, bamboo batting, which are typically 50% bamboo and 50% organic cotton blend batting, or combinations thereof. In various embodiments, bonded batting is used, which has a light adhesive on both sides to hold fibers together, which helps so the batting won't shift or beard.

Referring again to FIG. 6, in various embodiments, the proportion of the patterned comforter 10 comprising the first portion 12 and the second portion 14 can be varied, for example, with the second portion 14 comprising from about 30% to about 90% of the area of the patterned comforter 10, with the second portion 14 generally located to at least partially cover a user, such as a central area. In one embodiment, the second portion 14 comprises about 40% to about 60% of the area of the comforter 10. In various embodiments, the first portion 12 comprising a peripheral area of the patterned comforter 10 have the same width from an outer edge 16 to the second portion 14, or the width may independently vary for each of the peripheral portions, for example, the width of the bottom portion of the peripheral area may be greater than the width of the side portions. The first portion's 12 peripheral areas can range in width from about 3" to about 20", varying by application and fill material used.

The outer fabric panels 26 and 28 are configured so that the patterned comforter 10 covers the desired mattress size on which the comforter 10 is to be used, including the conventional sizes of twin, full, queen and king sizes. The patterned comforter 10 can be either approximately the size of the top of the mattress, or somewhat wider (up to 20 inches) than the top of the mattress.

Although a preferred embodiment of the invention has been disclosed here for the purposes of illustration, it should be understood that various changes, modifications and substitutions may be incorporated in the embodiment without departing from the spirit of the invention, which is defined by the claims which follow.

What is claimed is:

1. A bedding article having an area, the article comprising: a top edge, a bottom edge, a left edge, a right edge, and a central area defined by an outer fabric shell comprising at least a top panel and a bottom panel and a non-uniform stitching pattern connecting the top panel and bottom panel and a layer of fill material disposed between the top panel and bottom panel, wherein the non-uniform stitching pattern creates a plurality of first sized spaces and a plurality of larger second sized spaces between the top panel and bottom panel, the plurality of first sized spaces and larger second sized spaces configured to each contain a portion of the layer of fill material, wherein each first sized space has a first area and each larger second sized space has a second area that is larger than the first area, and wherein the plurality of first sized spaces are located in at least a first portion of the article, the plurality larger second sized spaces are located in at least a second portion of the article; and wherein the plurality of first sized spaces are not formed in the second portion of the article;

wherein the first portion of the article is disposed about at least a portion of the top edge, bottom edge, left edge, or the right edge and the second portion is disposed in at least a portion of the central area; and wherein the central area comprises about 30% to about 90% of the area of the article.

2. The bedding article of claim 1, wherein the larger second sized spaces contain a larger portion of the layer of fill material than the portion contained within the first sized spaces, and thus, provide increased warmth in the second portion of the article containing the larger second sized spaces.

3. The bedding article of claim 1, wherein the first sized spaces, due to their smaller size, have increased durability as compared to the larger second sized spaces, and thus, provide increased durability in the first portion of the bedding article containing the first sized spaces.

4. The bedding article of claim 1, wherein the first portion of the bedding article is defined by three edges of the bedding article and an interiorly defined demarcation, and the second portion of the bedding article comprises a single edge of the bedding article, along with the central area of the bedding article.

5. The bedding article of claim 4 wherein the three edges defining the first portion are either the left edge, the right edge, and the top edge, or the left edge, the right edge, and the bottom edge, and the single edge defining the second portion is either the top edge or the bottom edge.

6. The bedding article of claim 1, wherein the first portion of the bedding article is defined by two edges of the article and an interiorly defined demarcation, and the second portion of the bedding article is defined by two edges of the bedding article, along with the central area.

7. The bedding article of claim 6, wherein the two edges defining the first portion are either the left edge and the right edge, or the top edge and the bottom edge, and the two edges defining the second portion is either the top edge and the bottom edge, or the left edge and the right edge.

8. The bedding article of claim 1, wherein the first portion of the bedding article is defined by one edge of the article and an interiorly defined demarcation, and the second portion of the bedding article is defined by three remaining edges of the bedding article, along with the central area.

9. The bedding article of claim 8, wherein the one edge defining the first portion is selected from the left edge, the right edge, the top edge, or the bottom edge, and the second portion of the article comprises the three remaining edges, along with the central area.

10. The bedding article of claim 1, wherein the non-uniform stitching pattern comprises intersecting lines, the intersecting lines forming the plurality of first sized spaces and second larger sized spaces between the at least a top panel and a bottom panel.

11. The bedding article of claim 10, wherein the plurality of first sized spaces and second larger sized spaces are square, rectangular, or diamond shaped.

12. The bedding article of claim 1, wherein the second area of the larger second sized space is 10%, 20%, 30%, 40%, 50%, 60%, 70%, 80%, 90%, 100%, 150%, 200%, 300%, 400%, or 500% greater than the first area of the first sized space.

13. The bedding article of claim 1, wherein the fill material is selected from the group consisting of down, down-like material, wool, polyester, cotton, tencel, or combinations thereof.

14. The bedding article of claim 1, wherein the second portion comprises from about 40% to about 60% of the total area of the bedding article.

15. The bedding article of claim 1, wherein the bedding article is a comforter, a blanket, or a throw.

* * * * *